US005174135A

United States Patent [19]

Loughlin

[11] Patent Number: 5,174,135

[45] Date of Patent: Dec. 29, 1992

[54] TUBULAR HASP FOR PADLOCKS

[76] Inventor: Robert W. Loughlin, P.O. Box 129, Stanton, N.J. 08885

[21] Appl. No.: 712,059

[22] Filed: Jun. 6, 1991

[51] Int. Cl.[5] ..... E05B 65/48

[52] U.S. Cl. ..... 70/2; 70/56; 292/281

[58] Field of Search ..... 70/2-13, 70/54-56; 292/281-287

[56] References Cited

U.S. PATENT DOCUMENTS

| | | | |
|---|---|---|---|
| 1,690,041 | 10/1928 | Sundquist . | |
| 2,584,575 | 2/1952 | Goldwasser . | |
| 3,572,062 | 3/1971 | Beebe | 70/1.5 |
| 3,727,438 | 4/1973 | Knaack | 70/56 X |
| 3,916,654 | 11/1975 | Mudge | 70/56 |
| 4,031,719 | 6/1977 | Klinger | 70/56 |
| 4,033,155 | 7/1977 | DeLuca | 70/56 |
| 4,106,315 | 8/1978 | Dohanyos | 70/56 |
| 4,300,373 | 11/1981 | Camos et al. | 70/232 |
| 4,307,904 | 12/1981 | Daus | 292/148 |
| 4,380,160 | 4/1983 | Hoffman | 70/14 |
| 4,437,692 | 3/1984 | Halopoff | 292/57 |
| 4,535,612 | 8/1985 | Seremet | 70/56 |
| 4,576,022 | 3/1986 | Gamble | 70/55 |
| 4,655,487 | 4/1987 | Korn | 292/57 |
| 4,690,441 | 9/1987 | Fazzolari | 292/57 |
| 4,745,783 | 5/1988 | Poe | 70/54 X |
| 4,781,043 | 11/1988 | Loeffler | 70/54 |
| 4,788,836 | 12/1988 | Poe | 70/2 |
| 4,882,918 | 11/1989 | Stanich | 70/56 X |
| 4,949,560 | 8/1990 | Anderson | 70/2 X |
| 4,961,329 | 10/1990 | Anderson | 70/54 X |

*Primary Examiner*—Lloyd A. Gall

[57] ABSTRACT

A tubular hasp for padlocks having U-shaped shackles comprising two tubular elements that attach separately to each side of a closure structure. With the closure in the closed position and the padlock shackle in the unlocked, open position, and rotated away from the closure structure the padlock will fit into the larger tubular element until stopped by the shackle coming into contact with the front wall. The padlock is moved toward the smaller tubular element and the shackle rotated through an opening provided in the front wall of the smaller tubular element until it reaches alignment with the mating hole in the padlock. The shackle is then closed, latched and locked within the padlock body. The combination of these elements provides a secure arrangement of tubular hasp and padlock with the shackle protected from the commonly used methods of forced attack.

1 Claim, 3 Drawing Sheets

TUBULAR HASP FOR PADLOCKS

BACKGROUND—FIELD OF INVENTION

This invention generally pertains to a protective hasp attachment devices for padlock applications, and in particular to U-shaped shackle padlocks used in conjunction with general purpose hasps to secure doors, drawers, and various styles of closure structures.

The most commonly used padlocks and attachment devices such as fixed and articulated hasps and staples are typically loose fitting and of "U" shape. This assures ease of use, flexibility, and minimal cost. Unfortunately these configurations provide ease of forced attack using bolt cutters, prying tools and similar methods. Many many attempts have been made to protect these vulnerable elements. Typically the shackle is hidden within a protective structure as can be seen in the following U.S. Patents:

| | |
|---|---|
| 1,690,041 Sundquist | 2,584,575 Goldwasser |
| 3,572,062 Beebe | 3,727,438 Knaak |
| 3,916,654 Mudge | 4,031,719 Klinger |
| 4,033,155 DeLuca | 4,106,315 Dohanyos |
| 4,307,904 Daus | 4,380,160 Hoffman |
| 4,437,962 Halopoff | 4,535,612 Seremet |
| 4,576,022 Gamble | 4,655,487 Korn |
| 4,690,441 Fazzolari | 4,745,783 Poe |
| 4,781,043 Loeffler | 4,788,836 Poe |
| 4,949,560 Anderson | 4,961,329 Anderson |

The common disadvantage reflected in the prior art is the restrictive nature of the concepts that limit the applications and choice of padlock that can be used. The newer and better concepts often require costly manufacturing methods and find few applications as a result.

OBJECTS AND ADVANTAGES

The object of this invention is to provide a simple, versatile, hasp attachment device that incorporates enhanced protection from the more common methods of forced attack, and minimal manufacturing costs. Several advantages of this invention are:

a) The design will accept a variety of the U-shaped shackle padlocks in common use.

b) The design will attach to and work in cooperation with a variety of the doors, drawers, and closures currently secured with traditional hasps.

c) The design permits a variety of manufacturing methods and materials to assure compatibility with the security needs and economics of the application.

d) The design limits the motion of the attached padlock which enhances security and reduces the noise and surface damage often associated with traditional hasp applications on trucks and vans.

e) The design offers an attachment method using carriage bolt type fasteners that are secure from forced attack by virtue of their location within the structure, and of unlimited length as a result of the shape of the mounting slots. In addition this configuration provides great flexibility in locating the mounting bolts which can be very useful in difficult applications.

DRAWING FIGURES

Figure 1:
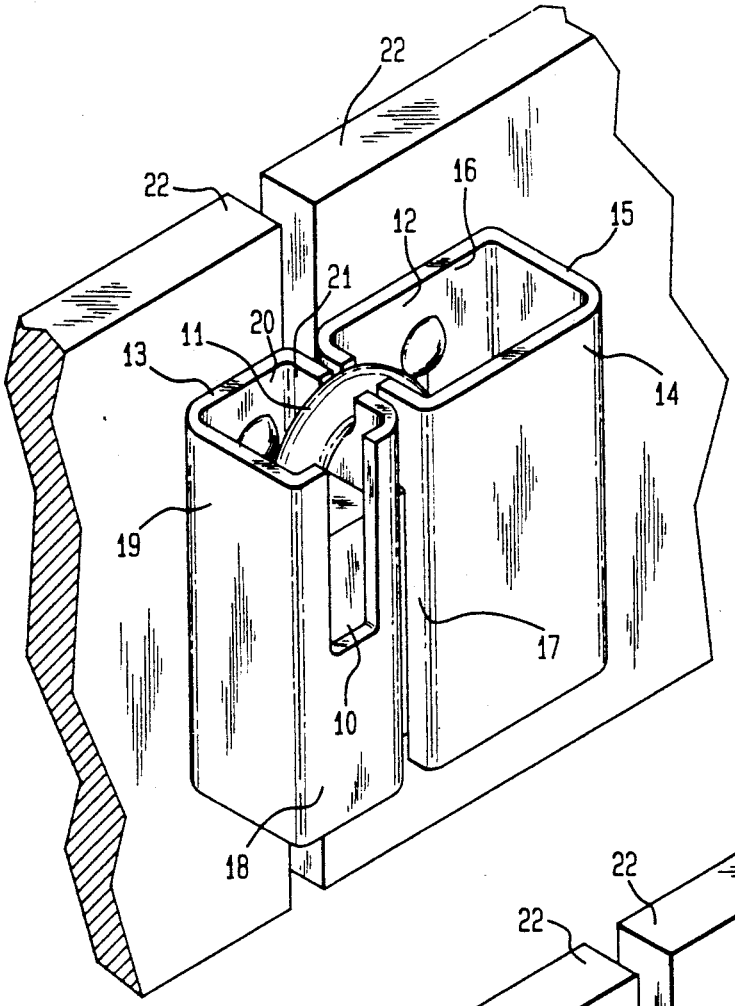
FIG. 1 shows a perspective view of the mounted tubular hasp, comprising two elements, attached to a closure in the closed position with the padlock in place, closed and locked.

| Reference Numerals In Drawings | | | |
|---|---|---|---|
| 10 | Padlock | 11 | Padlock shackle |
| 12 | Tubular hasp, large element | 13 | Tubular hasp, small element |
| 14 | Front wall, large element | 15 | outer end wall large element |
| 16 | Mounting wall, large element | 17 | Inner end wall large element |
| 18 | Front wall, small element | 19 | Outer end wall small element |
| 20 | Mounting wall, small element | 21 | Inner end wall small element |
| 22 | Closure | 23 | Axis of rotation of shackle |
| 24 | Carriage bolt type fastener of various length | 25 | Bolt head clearance hole |
| 26 | Longitudinal axis of mounting hardware | 27 | Mounting hardware slots |
| 28 | Closure doors | 29 | Van |
| 30 | Padlock axis of travel | | |

DESCRIPTION OF A PREFERRED EMBODIMENT

Figure 2:
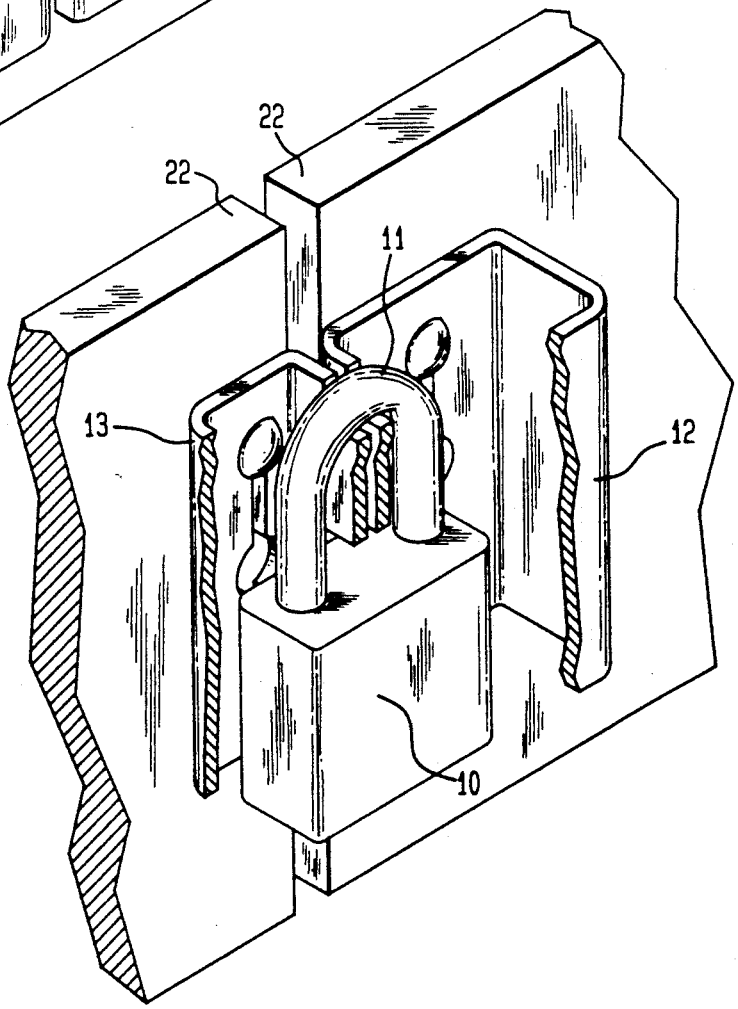
FIG. 2 shows a perspective view of a cutaway of both parts of the mounted tubular hasp, attached to a closure in the closed position with the padlock in place, closed and locked. This view shows how the padlock works in cooperation with the two elements of the tubular hasp.
Figure 4:
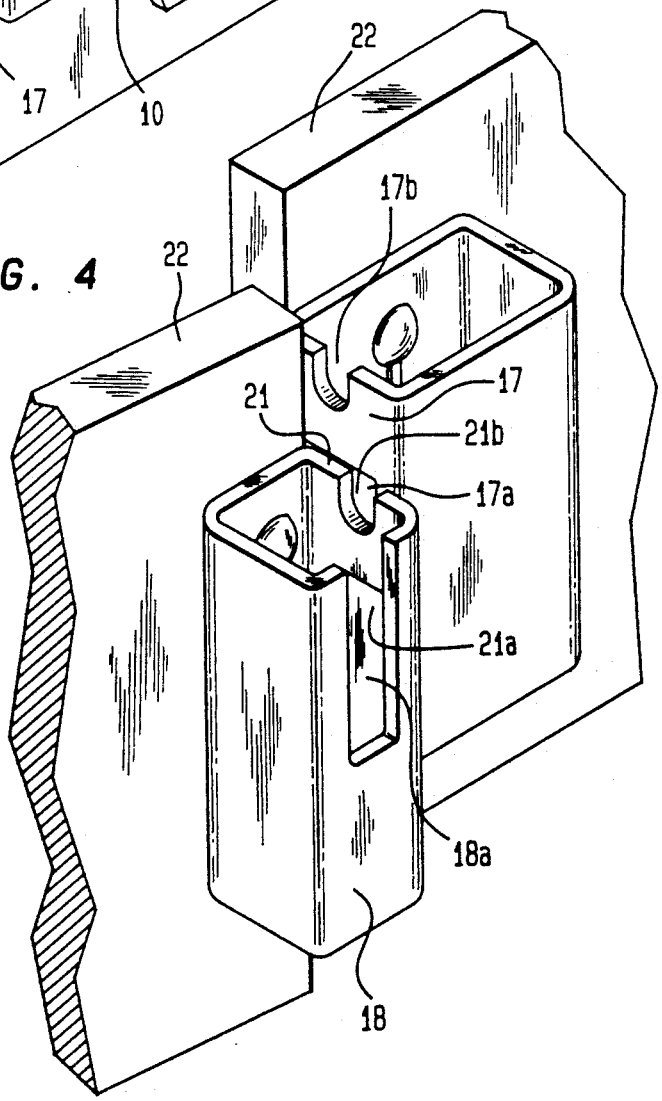
FIG. 4 shows a perspective view of the mounted tubular hasp with the padlock removed and the closure partly open.
Figure 5:
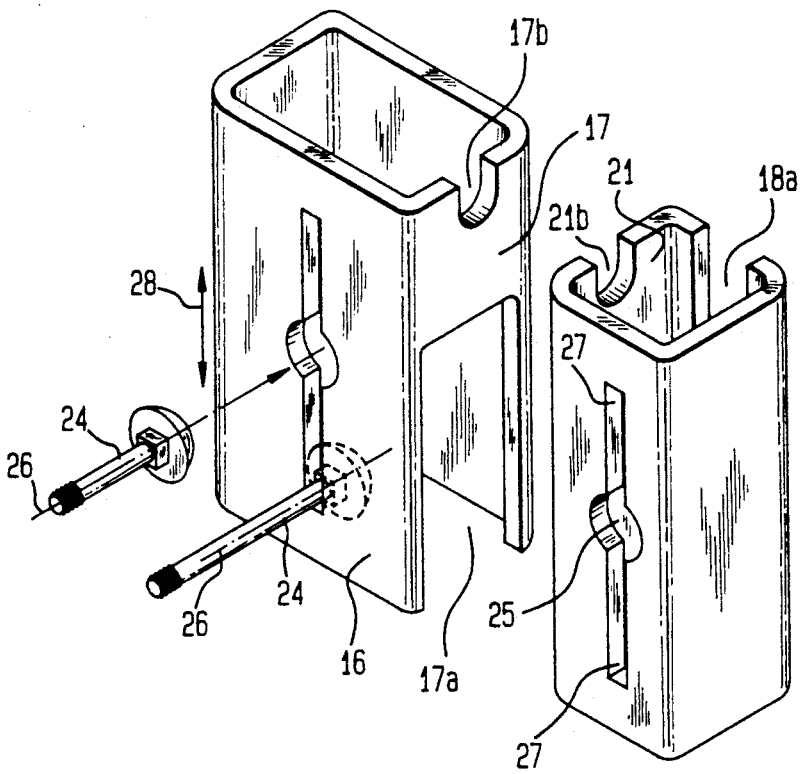
FIG. 5 shows a perspective view of the two elements of the unmounted tubular hasp from the mounting side with two carriage bolt type fasteners of different lengths, with the longer one in place and the shorter one not in place.

Refer now to FIG. 1 which is an overall drawing of a preferred embodiment of the invention. A conventional U-shackle padlock 10 is shown in FIG. 1 with the shackle 11, having a pivotable leg and a free leg which is swingable about the pivotable leg, closed and locked and this in place within and connecting the large element 12 and the small element 13 of the tubular hasp. The large element has a front wall 14 and outer end wall 15, mounting wall 16, containing mounting holes connected by slots as shown in FIG. 2, inner end wall 17, containing a first lock body opening **17*a* for the padlock body and a first shackle member opening 17*b* for the shackle as shown in FIGS. 4 and 5. The small element has a front wall 18, containing a leg opening 18*a* to clear the swing of the shackle 11 when rotated, the outer end wall 19, and mounting wall 20 containing mounting holes connected by slots as shown in FIG. 3, and an inner end wall 21 containing a second lock body opening 21*a* for the padlock body and a second shackle member opening 21*b*** for the shackle.

FIG. 2, illustrates, by cutaway, the cooperation of the padlock 10 when the large element 12 and small element 13 of the tubular hasp are mounted to a closure 22 in the closed position and the padlock 10 is installed within and securely connecting the large and small elements of the tubular hasp with the shackle in the closed and locked position.

Figure 3:
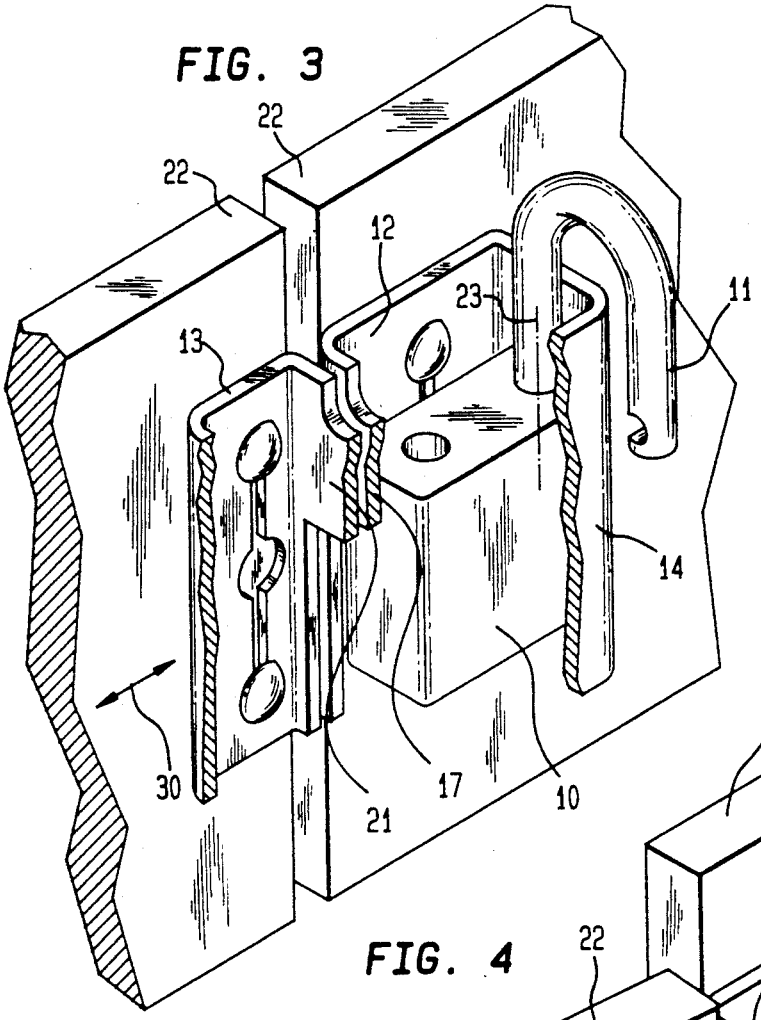
FIG. 3 shows a perspective view of a cutaway of both parts of the mounted tubular hasp attached to a closure in the closed position with the padlock unlocked, the shackle open and rotated to clear the tubular hasp, and moved to the larger element permitting the elements to separate and the closure to open.

FIG. 3, illustrates, by cutaway, the cooperation of the padlock 10 when the large element 12 and the small element 13 of the tubular hasp are mounted to a closure 22 in the closed position and the padlock 10 is located within the large element 12 with the shackle 11 in the unlocked and open position and rotated about its axis of rotation 23 sufficiently to clear the front wall 14 permitting the padlock 10 to move freely between the position illustrated here and that illustrated in FIG. 2. along an axis of travel 30.

FIG. 4, illustrates the freedom of the closure 22 to move open when the padlock is not in position to work in cooperation to secure the large and small elements of the tubular hasp.

FIG. 5, illustrates the method for mounting the tubular hasp using various lengths of carriage bolt type fasteners 24 which are inserted through bolt hole 25 in the mounting wall 16 along their longitudinal axis 26. The mounting hardware 24 is then free to move into the mounting slots 27 and free to move along the axis 28 of the slots 27 to accommodate mounting location requirements of the closure 22.

Figure 6:
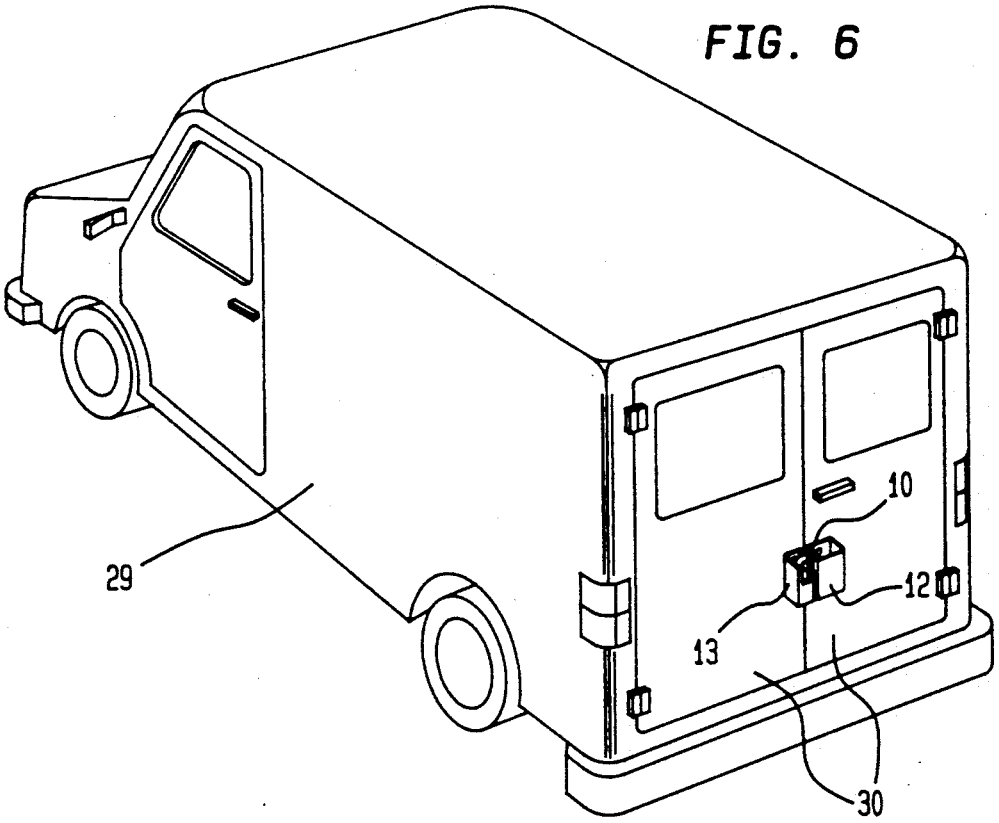
FIG. 6 shows a perspective view of the two elements of the tubular hasp attached to the rear doors of a van secured with padlock installed and locked.

FIG. 6, illustrates the two elements 12 and 13 of the tubular hasp installed and secured using a padlock 10 on the rear doors 28 of a van 29.

The foregoing describes a common application of a fixed hasp to provide an attachment means to use a padlock to secure a typical closure. The traditional devices do not provide adequate protection from forced attack using well known and readily available tools and methods. This invention provides two tubular elements to accept a conventional padlock, that in combination and attached to the closure to be secured will provide a snug fitting assembly hiding the vulnerable elements, reduce rattling and deter forced attack.

The foregoing description of the preferred embodiment of the invention has been presented for the purposes of illustration and description. It is not intended to be exhaustive of or to limit the invention to the precise form disclosed, many modifications and variations are possible in light of the above teaching. It is intended that the scope of the invention be limited not by this detailed description, but rather by the claims appended hereto.

I claim:

1. A protective tubular hasp for use in connection with a shackle padlock of the type having a lock body and a U-shaped shackle member being movable longitudinally relative to the lock body between a closed, locked position and an open, unlocked position, the U-shaped shackle member having a first leg pivotally carried by the lock body and a second leg freely swingable about the first leg when the shackle member is in the open, unlocked position, said protective hasp comprising:

a first hollow tubular member adapted to receive at least a portion of the shackle padlock within the interior thereof, the longitudinal dimension of said first tubular member being greater than the longitudinal length of the shackle member when the shackle member is in the closed, locked position;

said first tubular member having a first lock body opening and a first shackle member opening in a first wall thereof, said first lock body opening being sized and arranged in said first wall so that the lock body can at least partially pass through said first lock body opening when the shackle member is in the open, unlocked position and rotated to allow such passage, said first shackle member opening being sized and arranged in said first wall to receive at least a portion of the shackle member when the lock body is in said first lock body opening and the shackle member is in the closed, locked position;

a second hollow tubular member being adapted to be arranged adjacent to said first tubular member such that a second wall thereof is opposite said first wall of said first tubular member, and being adapted to receive at least a portion of the shackle padlock within the interior thereof;

said second tubular member having a second lock body opening being sized and arranged in said second wall so that at least a portion of the lock body can at least partially pass through said second lock body opening after passing through said first lock body opening of said first tubular member and a second shackle member opening being sized and arranged in said second wall to receive at least a portion of the shackle member when the lock body is in said first and second lock body openings and the shackle member is in the closed, locked position;

said second tubular member having a front wall, said front wall of said second tubular member having a second leg opening sized and arranged therein so that the second leg of the shackle member can freely swing therethrough when the lock body is in said first and second lock body openings and the shackle member is in the open, unlocked position; and said first and second lock body openings and said first and second shackle member openings being sized and arranged so that when the second leg of the shackle member is swung through said second leg opening of said second tubular member, said shackle member may close, latch and lock within the lock body.

* * * * *